US008603953B2

(12) United States Patent
Aoki et al.

(10) Patent No.: US 8,603,953 B2
(45) **Date of Patent: *Dec. 10, 2013**

(54) OPERATING OIL FOR BUFFER

(75) Inventors: Tooru Aoki, Yokohama (JP); Kazuo Tagawa, Yokohama (JP); Shinichi Shirahama, Yokohama (JP)

(73) Assignee: JX Nippon Oil & Energy Corporation, Tokyo (JP)

( * ) Notice: Subject to any disclaimer, the term of this patent is extended or adjusted under 35 U.S.C. 154(b) by 403 days.

This patent is subject to a terminal disclaimer.

(21) Appl. No.: 12/593,325

(22) PCT Filed: Mar. 25, 2008

(86) PCT No.: PCT/JP2008/055577

§ 371 (c)(1),
(2), (4) Date: Feb. 4, 2010

(87) PCT Pub. No.: WO2008/123249

PCT Pub. Date: Oct. 16, 2008

(65) Prior Publication Data

US 2010/0137176 A1 Jun. 3, 2010

(30) Foreign Application Priority Data

Mar. 30, 2007 (JP) ..... 2007-094576

(51) Int. Cl.
*C10G 71/00* (2006.01)
*C10M 169/04* (2006.01)

(52) U.S. Cl.
USPC ..... 508/110; 208/18

(58) Field of Classification Search
USPC ..... 508/110, 552; 208/18
See application file for complete search history.

(56) References Cited

U.S. PATENT DOCUMENTS

| | | | | |
|---|---|---|---|---|
| 2,861,941 | A * | 11/1958 | Jancosek et al. | 208/25 |
| 2,890,161 | A | 6/1959 | Brown et al. | |
| 3,078,222 | A | 2/1963 | Henke et al. | |
| 3,847,790 | A | 11/1974 | Putz | |
| 5,282,958 | A | 2/1994 | Santilli et al. | |
| 6,059,955 | A | 5/2000 | Cody et al. | |
| 6,090,989 | A * | 7/2000 | Trewella et al. | 585/13 |
| 6,103,099 | A * | 8/2000 | Wittenbrink et al. | 208/27 |
| 6,179,994 | B1 * | 1/2001 | Clark et al. | 208/27 |
| 6,420,618 | B1 * | 7/2002 | Berlowitz et al. | 585/310 |
| 6,602,402 | B1 | 8/2003 | Benazzi et al. | |
| 2001/0027169 | A1 * | 10/2001 | Kurihara et al. | 508/469 |
| 2004/0045868 | A1 | 3/2004 | Germaine | |
| 2004/0074810 | A1 | 4/2004 | Hoek et al. | |
| 2004/0077505 | A1 | 4/2004 | Daniel et al. | |
| 2004/0079675 | A1 | 4/2004 | Germaine et al. | |
| 2004/0099571 | A1 | 5/2004 | Germaine et al. | |
| 2004/0118744 | A1 | 6/2004 | Daniel et al. | |
| 2004/0119046 | A1 | 6/2004 | Carey et al. | |
| 2004/0129603 | A1 | 7/2004 | Fyfe et al. | |
| 2004/0154957 | A1 | 8/2004 | Keeney et al. | |
| 2004/0154958 | A1 | 8/2004 | Alexander et al. | |
| 2004/0209786 | A1 * | 10/2004 | Sagawa et al. | 508/371 |
| 2005/0003974 | A1 * | 1/2005 | Briggs et al. | 508/591 |
| 2006/0205610 | A1 * | 9/2006 | Rosenbaum et al. | 508/110 |
| 2010/0130395 | A1 * | 5/2010 | Tagawa et al. | 508/552 |
| 2011/0003725 | A1 | 1/2011 | Matsui et al. | |
| 2011/0049008 | A1 * | 3/2011 | Tagawa et al. | 208/18 |
| 2011/0049009 | A1 * | 3/2011 | Tagawa et al. | 208/18 |

FOREIGN PATENT DOCUMENTS

| | | |
|---|---|---|
| EP | 1845151 | 10/2007 |
| EP | 2135928 | 12/2009 |
| EP | 2241611 | 10/2010 |
| JP | 30-000624 | 2/1955 |
| JP | 31-003928 | 5/1956 |
| JP | 45-019183 | 7/1970 |
| JP | 48-025003 | 4/1973 |
| JP | 3-285989 | 12/1991 |
| JP | 5-086390 | 4/1993 |
| JP | 5-247482 | 9/1993 |
| JP | 5-508876 | 12/1993 |
| JP | 6-220480 | 8/1994 |
| JP | 2000-044971 | 2/2000 |
| JP | 2000-109876 | 4/2000 |
| JP | 2000-119672 | 4/2000 |
| JP | 2000-345170 | 12/2000 |
| JP | 2000-345171 | 12/2000 |
| JP | 2001-520302 | 10/2001 |
| JP | 2002-503752 | 2/2002 |
| JP | 2004-182931 | 7/2004 |
| JP | 2004-528426 | 9/2004 |
| JP | 2005-314609 | 11/2005 |
| JP | 2006-502303 | 1/2006 |
| JP | 2006-509899 | 3/2006 |
| JP | 2006-518395 | 8/2006 |
| JP | 2006-241436 | 9/2006 |
| JP | 2006-521416 | 9/2006 |
| JP | 2007-186638 | 7/2007 |

(Continued)

OTHER PUBLICATIONS

International Search Report for PCT/JP2008/055577, mailing date Jun. 24, 2008.

(Continued)

*Primary Examiner* — Prem C Singh

*Assistant Examiner* — Francis C Campanell

(74) *Attorney, Agent, or Firm* — Greenblum & Bernstein, P.L.C.

(57) ABSTRACT

The shock absorber fluid according to the invention is characterized by comprising a lubricating base oil that has a urea adduct value of not greater than 4% by mass and a viscosity index of 100 or greater. The shock absorber fluid according to the invention can exhibit a high level of all properties including viscosity-temperature characteristic, shear stability and antifoaming property.

4 Claims, No Drawings

(56) References Cited

FOREIGN PATENT DOCUMENTS

| | | |
|---|---|---|
| JP | 2007-270062 | 10/2007 |
| WO | 2004/053030 | 6/2004 |
| WO | 2005/090528 | 9/2005 |

OTHER PUBLICATIONS

English Translation of the International Preliminary Report on Patentability and Written Opinion for PCT/JP2008/055577, issued Oct. 13, 2009.

Veretennikova T N et al., "Mechanism of action of pour-point depressants in diesel fuels", Chemistry and Technology of Fuels and Oils, Consultants Bureau, US, vol. 16, No. 6, XP007918564 , Jun. 1, 1980, pp. 392-395.

Krishna R et al., "Correlation of pour point of gas oil and vacuum gas oil fractions with compositional parameters", Energy & Fuels, American Chemical Society, Washington, DC, US, vol. 3, No. 1, XP007918565, Jan. 1, 1989, pp. 15-20.

Sharma et al., "Predicting Low Temperature Lubricant Rheology Using Nuclear Magnetic Resonance Spectroscopy and Mass Spectrometry", Tribology Letters, Kluwer Academic Publishers-Plenum Publishers, NE, vol. 16, No. 1-2, XP007918586, Feb. 1, 2004, pp. 11-19.

Lilianna Z Pillon, "Use of NMR Spectroscopy to Study the Effect of Hydrocraking on the Chemistry of Hydrocarbons", Petroleum Science and Technology, Marcel Dekker, New York, NY, US, vol. 20, No. 3&4, XP009148193 , Jan. 1, 2002, pp. 357-365.

Turner C H et al., "Estimation of chain branching in paraffin waxes using proton magnetic resonance spectroscopy and gas-liquid chromatography", Journal of Chromatography, Elsevier Science Publishers B.V, NL, vol. 287. XP026476547, Jan. 1, 1984, pp. 305-312.

Search report from E.P.O. that issued with respect to patent family member European Patent Application No. 0872278.2, mail date is May 25, 2011.

Shinya Sato et al., "Separation of n-Paraffin and 1-Olefin in Shale Oil by Urea Adduct Method", Sekiyu Gakkaishi, vol. 39, No. 5, 1996, pp. 365-368, with partial English-language translation.

J.P.O. Notice of Information Provision issued with respect to patent family member Japanese Patent Application No. 2009-509115, mailed Jul. 3, 2012.

Office Action for Japanese Application No. 2009-509115, mailed May 14, 2013.

Yozo Oshima et al., "Monomethylparaffins in n—Paraffins Adducted from Petroleum Fractions", Sekiyu Gakkaishi, vol. 18, No. 6, 1975, pp. 497-502 along with partial English translation.

Hiroshi Ohtsuka et al., "Separation of Straight—Chain Hydrocarbons from petroleum Franctions by Means of Urea—Addcut Formation", Bulletin of the Faculty of Engineering, Hokkaido University, Mar. 30, 1966, pp. 125-137 along with partial English translation.

Japanese Notification of Information Provision for JP Patent Application No. 2009-509115, mail date is Sep. 3, 2013.

* cited by examiner

OPERATING OIL FOR BUFFER

TECHNICAL FIELD

The present invention relates to a shock absorber fluid.

BACKGROUND ART

As conventional shock absorber fluids there are known, for example, those employing poly-α-olefins, esters, silicone oils or deep dewaxed base oils. It has also been attempted to improve the properties of conventional shock absorber fluids by addition of various additives (for example, Patent documents 1-9).

[Patent document 1] Japanese Unexamined Patent Publication HEI No. 3-285989

[Patent document 2] Japanese Unexamined Patent Publication HEI No. 5-86390

[Patent document 3] Japanese Unexamined Patent Publication HEI No. 5-247482

[Patent document 4] Japanese Unexamined Patent Publication HEI No. 6-220480

[Patent document 5] Japanese Unexamined Patent Publication No. 2000-119672

[Patent document 6] Japanese Unexamined Patent Publication No. 2000-044971

[Patent document 7] Japanese Unexamined Patent Publication No. 2000-109876

[Patent document 8] Japanese Unexamined Patent Publication No. 2000-119672

[Patent document 9] Japanese Unexamined Patent Publication No. 2005-314609

DISCLOSURE OF THE INVENTION

Problems to be Solved by the Invention

However, the conventional shock absorber fluids described above are still in need of improvement.

Specifically, a shock absorber fluid must be able to exhibit satisfactory buffer action or damping force even at low temperatures, and in recent years the demands for such low-temperature characteristics have become even more stringent. For example, in order to obtain satisfactory buffer action or damping force without impairing the low temperature flow property, it is considered desirable for the Brookfield viscosity to be not greater than 2000 mPa·s at the required temperature. Moreover, recent years have produced a demand for shock absorber fluids that sufficiently exhibit low-temperature performance even at outdoor temperatures of −40° C.

In order to lower the Brookfield viscosity at −40° C. to below 2000 mPa·s for shock absorber fluids, it has been necessary to add low viscosity solvent components to lower the base oil viscosity and add considerable amounts of viscosity index improvers. However, addition of a large amount of solvent components impairs the lubricity. In addition, when a viscosity index improver is added in a large amount, the viscosity index improver is subjected to shear force during use and the viscosity of the shock absorber fluid is reduced. As a result, the viscosity necessary for the shock absorber fluid cannot be maintained and the lubricity is impaired, while the prescribed damping force is also no longer maintained and in extreme cases the shock absorber must be replaced.

Moreover, a shock absorber fluid must also be able to inhibit foam generation under harsh conditions, and minimize reduction in damping force. However, conventional shock absorber fluids have not been able to easily maintain a sufficient antifoaming property for long periods even with defoaming agents and viscosity index improvers.

It is an object of the present invention, which has been accomplished in light of these circumstances, to provide a shock absorber fluid which can exhibit a high level of all properties including the viscosity-temperature characteristic, shear stability and antifoaming property.

Means for Solving the Problems

In order to solve the problems described above, the invention provides a shock absorber fluid (which concept also encompasses a hydraulic oil for a shock absorber) characterized by comprising a lubricating base oil that has a urea adduct value of not greater than 4% by mass and a viscosity index of 100 or greater.

The urea adduct value according to the invention is measured by the following method. A 100 g weighed portion of sample oil (that is lubricating base oil) is placed in a round bottom flask, 200 g of urea, 360 ml of toluene and 40 ml of methanol are added and the mixture is stirred at room temperature for 6 hours. This produces white particulate crystals as urea adduct in the reaction mixture. The reaction mixture is filtered with a 1 micron filter to obtain the produced white particulate crystals, and the crystals are washed 6 times with 50 ml of toluene. The recovered white crystals are placed in a flask, 300 ml of pure water and 300 ml of toluene are added and the mixture is stirred at 80° C. for 1 hour. The aqueous phase is separated and removed with a separatory funnel, and the toluene phase is washed 3 times with 300 ml of pure water. After dewatering treatment of the toluene phase by addition of a desiccant (sodium sulfate), the toluene is distilled off. The proportion (mass percentage) of urea adduct obtained in this manner with respect to the sample oil is defined as the urea adduct value.

The viscosity index according to the invention, and the kinematic viscosity at 40° C. or 100° C. mentioned hereunder, are the viscosity index and kinematic viscosity at 40° C. or 100° C. as measured according to JIS K 2283-1993.

The lubricating base oil in the shock absorber fluid according to the invention has a urea adduct value and viscosity index satisfying the respective conditions specified above, and therefore the lubricating base oil itself has an excellent viscosity-temperature characteristic and low-temperature viscosity characteristic. Furthermore, a shock absorber fluid according to the invention that contains the aforementioned lubricating base oil can exhibit an excellent low-temperature viscosity characteristic and sufficient buffer action or damping force even at low temperatures. In addition, since the lubricating base oil in the shock absorber fluid according to the invention has excellent antifoaming performance and defoaming properties, it is possible to minimize reduction in damping force of the shock absorber caused by foaming and to maintain excellent damping force even under severe conditions. Moreover, using the aforementioned lubricating base oil can reduce the amount of lower viscosity base oils or solvents, and allows the viscosity index improver content to be reduced as well, and it is thus possible to obtain a composition exhibiting not only excellent lubricity but also excellent shear stability, while maintaining sufficient lubricity and damping force of the shock absorber that can also withstand prolonged use.

While efforts are being made to improve the isomerization rate from normal paraffins to isoparaffins in conventional refining processes for lubricating base oils by hydrocracking and hydroisomerization, the present inventors have found through careful study that it is difficult to satisfactorily improve the low-temperature viscosity characteristic simply by reducing the residual amount of normal paraffins. That is, although the isoparaffins produced by hydrocracking and hydroisomerization also contain components that adversely affect the low-temperature viscosity characteristic, this fact has not been fully appreciated in the conventional methods of evaluation. Methods such as gas chromatography (GC) and NMR are also applied for analysis of normal paraffins and isoparaffins, but using these analysis methods for separation and identification of the components in isoparaffins that adversely affect the low-temperature viscosity characteristic involves complicated procedures and is time-consuming, making them ineffective for practical use.

With measurement of the urea adduct value according to the invention, on the other hand, it is possible to accomplish precise and reliable collection of components in isoparaffins that can adversely affect the low-temperature viscosity characteristic, as well as normal paraffins when normal paraffins are residually present in the lubricating base oil, and it is therefore an excellent indicator for evaluation of the low-temperature viscosity characteristic of lubricating base oils. The present inventors have confirmed that when analysis is conducted using GC and NMR, the main urea adducts are urea adducts of normal paraffins and of isoparaffins with 6 or more carbon atoms from the end of main chain to the point of branching.

The shock absorber fluid according to the invention preferably further comprises a viscosity index improver. In this case, the viscosity index improver content is preferably not greater than 2.5% by mass, as the polymer amount based on the total amount of the shock absorber fluid.

Effect of the Invention

According to the invention there is provided a shock absorber fluid which can exhibit a high level of all properties including the viscosity-temperature characteristic, shear stability and antifoaming property.

BEST MODE FOR CARRYING OUT THE INVENTION

A preferred embodiment of the invention will now be described in detail.

The shock absorber fluid according to the invention comprises a lubricating base oil, hereinafter referred to as "lubricating base oil of the invention", with a urea adduct value of not greater than 4% by mass and a viscosity index of 100 or greater.

From the viewpoint of improving the low-temperature viscosity characteristic without impairing the viscosity-temperature characteristic, the urea adduct value of the lubricating base oil of the invention must be not greater than 4% by mass as mentioned above, but it is preferably not greater than 3.5% by mass, more preferably not greater than 3% by mass and even more preferably not greater than 2.5% by mass. The urea adduct value of the lubricating base oil may even be 0% by mass. However, it is preferably 0.1% by mass or greater, more preferably 0.5% by mass or greater and most preferably 0.8% by mass or greater, from the viewpoint of obtaining a lubricating base oil with a sufficient low-temperature viscosity characteristic and higher viscosity index, and also of relaxing the dewaxing conditions for increased economy.

From the viewpoint of improving the viscosity-temperature characteristic, the viscosity index of the lubricating base oil of the invention must be 100 or higher as mentioned above, but it is preferably 110 or greater, more preferably 120 or greater, even more preferably 125 or greater, yet more preferably 130 or greater and most preferably 140 or greater.

The feedstock oil used for production of the lubricating base oil of the invention may include normal paraffins or normal paraffin-containing wax. The feedstock oil may be a mineral oil or a synthetic oil, or a mixture of two or more thereof.

The feedstock oil used for the invention preferably is a wax-containing feedstock that boils in the range of lubricating oils according to ASTM D86 or ASTM D2887. The wax content of the feedstock oil is preferably at least 50% by mass and less than 100% by mass based on the total amount of the feedstock oil. The wax content of the feedstock can be measured by methods of analysis such as nuclear magnetic resonance spectroscopy (ASTM D5292), correlative ring analysis (n-d-M) (ASTM D3238) or the solvent method (ASTM D3235).

As examples of wax-containing feedstocks there may be mentioned oils derived from solvent refining methods, such as raffinates, partial solvent dewaxed oils, deasphalted oils, distillates, vacuum gas oils, coker gas oils, slack waxes, foot oil, Fischer-Tropsch waxes and the like, among which slack waxes and Fischer-Tropsch waxes are preferred.

Slack wax is typically derived from hydrocarbon feedstocks by solvent or propane dewaxing. Slack waxes may contain residual oil, but the residual oil can be removed by deoiling. Foot oil corresponds to deoiled slack wax.

Fischer-Tropsch waxes are produced by so-called Fischer-Tropsch synthesis.

Commercial normal paraffin-containing feedstock oils are also available. Specifically, there may be mentioned Paraflint 80 (hydrogenated Fischer-Tropsch wax) and Shell MDS Waxy Raffinate (hydrogenated and partially isomerized middle distilled synthetic wax raffinate).

Feedstock oil from solvent extraction is obtained by feeding a high boiling point petroleum fraction from atmospheric pressure distillation to a vacuum distillation apparatus and subjecting the distillation fraction to solvent extraction. The residue from vacuum distillation may also be deasphalted. In solvent extraction methods, the aromatic components are dissolved in the extracted phase while leaving the more paraffinic components in the raffinate phase. Naphthenes are distributed in the extracted phase and raffinate phase. The preferred solvents for solvent extraction are phenols, furfurals and N-methylpyrrolidone. By controlling the solvent/oil ratio, extraction temperature and method of contacting the solvent with the distillate to be extracted, it is possible to control the degree of separation between the extract phase and raffinate phase.

The lubricating base oil of the invention may be obtained through a process of hydrocracking/hydroisomerization of the feedstock oil until the treated product has a urea adduct value of not greater than 4% by mass and a viscosity index of 100 or greater. The hydrocracking/hydroisomerization process is not particularly restricted so long as it satisfies the aforementioned conditions for the urea adduct value and viscosity index of the treated product. A preferred hydrocracking/hydroisomerization process according to the invention comprises a first process in which a normal paraffin-containing feedstock oil is subjected to hydrotreatment using a hydrotreating catalyst, a second process in which the treated product from the first process is subjected to hydrodewaxing using a hydrodewaxing catalyst, and a third process in which the t treated product from the second process is subjected to hydrorefining using a hydrorefining catalyst.

Conventional hydrocracking/hydroisomerization also includes a hydrotreatment process in an early stage of the hydrodewaxing process, for the purpose of desulfurization and denitration to prevent poisoning of the hydrodewaxing catalyst. In contrast, the first process (hydrotreatment process) according to the invention is carried out to decompose a portion (for example, about 10% by mass and preferably 1-10% by mass) of the normal paraffins in the feedstock oil at an early stage of the second process (hydrodewaxing process), thus allowing desulfurization and denitration in the first process as well, although the purpose differs from that of conventional hydrotreatment. The first process is preferred in order to reliably limit the urea adduct value of the treated product obtained after the third process (the lubricating base oil) to not greater than 4% by mass.

As hydrogenation catalysts to be used in the first process there may be mentioned catalysts containing Group 6 metals and Group 8-10 metals, as well as mixtures thereof. As preferred metals there may be mentioned nickel, tungsten, molybdenum and cobalt, and mixtures thereof. The hydrogenation catalyst may be used in a form with the aforementioned metals supported on a heat resistant metal oxide support, and normally the metal will be present on the support as an oxide or sulfide. When a mixture of metals is used, it may be used as a bulk metal catalyst with an amount of metal of at least 30% by mass based on the total amount of the catalyst. The metal oxide support may be an oxide such as silica, alumina, silica-alumina or titania, with alumina being preferred. Preferred alumina is γ or β porous alumina. The loading amount of the metal is preferably 0.5-35% by mass based on the total amount of the catalyst. When a mixture of a metal of Group 9-10 and a metal of Group 6 is used, preferably the metal of Group 9 or 10 is present in an amount of 0.1-5% by mass and the metal of Group 6 is present in an amount of 5-30% by mass based on the total amount of the catalyst. The loading amount of the metal may be measured by atomic absorption spectrophotometry or inductively coupled plasma emission spectroscopy, or the individual metals may be measured by other ASTM methods.

The acidity of the metal oxide support can be controlled by controlling the addition of additives and the nature of the metal oxide support (for example, controlling the amount of silica incorporated in a silica-alumina support). As examples of additives there may be mentioned halogens, especially fluorine, and phosphorus, boron, yttria, alkali metals, alkaline earth metals, rare earth oxides and magnesia. Co-catalysts such as halogens generally raise the acidity of metal oxide supports, but weakly basic additives such as yttria and magnesia can be used to lower the acidity of the support.

As regards the hydrotreatment conditions, the treatment temperature is preferably 150-450° C. and more preferably 200-400° C., the hydrogen partial pressure is preferably 1400-20,000 kPa and more preferably 2800-14,000 kPa, the liquid space velocity (LHSV) is preferably 0.1-10 $hr^{-1}$ and more preferably 0.1-5 $hr^{-1}$, and the hydrogen/oil ratio is preferably 50-1780 $m^3/m^3$ and more preferably 89-890 $m^3/m^3$. These conditions are only for example, and the hydrotreatment conditions in the first process may be appropriately selected for different feedstocks, catalysts and apparatuses, in order to obtain the specified urea adduct value and viscosity index for the treated product obtained after the third process.

The treated product obtained by hydrotreatment in the first process may be directly supplied to the second process, but a process of stripping or distillation of the treated product and separation and removal of the gas product from the treated product (liquid product) is preferably conducted between the first process and second process. This can reduce the nitrogen and sulfur contents in the treated product to levels that will not affect prolonged use of the hydrodewaxing catalyst in the second process. The main objects of separating removal by stripping and the like are gaseous contaminants such as hydrogen sulfide and ammonia, and stripping can be accomplished by ordinary means such as a flash drum, distiller or the like.

When the hydrotreatment conditions in the first process are mild, polycyclic aromatic components can potentially remain, and such contaminants may be removed by hydrorefining in the third process.

The hydrodewaxing catalyst used in the second process may contain crystalline or amorphous materials. As examples of crystalline materials there may be mentioned molecular sieves having 10- or 12-membered ring channels, composed mainly of aluminosilicates (zeolite) or silicoaluminophosphates (SAPO). As specific examples of zeolites there may be mentioned ZSM-22, ZSM-23, ZSM-35, ZSM-48, ZSM-57, ferrierite, ITQ-13, MCM-68, MCM-71 and the like. ECR-42 may be mentioned as an example of an aluminophosphate. As examples of molecular sieves there may be mentioned zeolite beta and MCM-68. Among the above there are preferably used one or more selected from among ZSM-48, ZSM-22 and ZSM-23, with ZSM-48 being particularly preferred. The molecular sieves are preferably hydrogen-type. Reduction of the hydrodewaxing catalyst may occur at the time of hydrodewaxing, but alternatively a hydrodewaxing catalyst that has been previously subjected to reduction treatment may be used for the hydrodewaxing.

As amorphous materials for the hydrodewaxing catalyst there may be mentioned alumina doped with Group 3 metals, fluorinated alumina, silica-alumina, fluorinated silica-alumina, silica-alumina and the like.

A preferred mode of the dewaxing catalyst is a bifunctional catalyst, i.e. one carrying a metal hydrogenated component and the metal is at least one metal of Group 6, at least one metal of Groups 8-10 or a mixture thereof. Preferred metals are precious metals of Groups 9-10, such as Pt, Pd or mixtures thereof. Such metals are supported at preferably 0.1-30% by mass based on the total amount of the catalyst. The method for preparation of the catalyst and loading of the metal may be, for example, an ion exchange method or impregnation method using a decomposable metal salt.

When molecular sieves are used, they may be compounded with a binder material that is heat resistant under the hydrodewaxing conditions, or they may be binderless (self-binding). As binder materials there may be mentioned inorganic oxides, including silica, alumina, silica-alumina, two-component combinations of silica with other metal oxides such as titania, magnesia, yttria and zirconia, and three-containing combinations of oxides such as silica-alumina-yttria, silica-alumina-magnesia and the like. The amount of molecular sieves in the hydrodewaxing catalyst is preferably 10-100% by mass and more preferably 35-100% by mass based on the total amount of the catalyst. The hydrodewaxing catalyst may be formed by a method such as spray-drying or extrusion. The hydrodewaxing catalyst may be used in sulfided or non-sulfided form, although a sulfided form is preferred.

As regards the hydrodewaxing conditions, the temperature is preferably 250-400° C. and more preferably 275-350° C., the hydrogen partial pressure is preferably 791-20,786 kPa (100-3000 psig) and more preferably 1480-17,339 kPa (200-2500 psig), the liquid space velocity is preferably 0.1-10 $hr^{-1}$ and more preferably 0.1-5 $hr^{-1}$, and the hydrogen/oil ratio is preferably 45-1780 $m^3/m^3$ (250-10,000 scf/b) and more preferably 89-890 $m^3/m^3$ (500-5000 scf/b). These conditions are only for example, and the hydrodewaxing conditions in the second process may be appropriately selected for different feedstocks, catalysts and apparatuses, in order to obtain the specified urea adduct value and viscosity index for the treated product obtained after the third process.

The treated product that has been hydrodewaxed in the second process is then supplied to hydrorefining in the third process. Hydrorefining is a form of mild hydrotreatment aimed at removing residual heteroatoms and color components while also saturating the olefins and residual aromatic compounds by hydrogenation. The hydrorefining in the third process may be carried out in a cascade fashion with the dewaxing process.

The hydrorefining catalyst used in the third process is preferably one comprising a Group 6 metal, a Group 8-10 metal or a mixture thereof supported on a metal oxide support. As preferred metals there may be mentioned precious metals, and especially platinum, palladium and mixtures thereof. When a mixture of metals is used, it may be used as a bulk metal catalyst with an amount of metal of 30% by mass or greater based on the amount of the catalyst. The metal content of the catalyst is preferably not greater than 20% by mass of non-precious metals and preferably not greater than 1% by mass of precious metals. The metal oxide support may be either an amorphous or crystalline oxide. Specifically, there may be mentioned low acidic oxides such as silica, alumina, silica-alumina and titania, with alumina being preferred. From the viewpoint of saturation of aromatic compounds, it is preferred to use a hydrorefining catalyst comprising a metal with a relatively powerful hydrogenating function supported on a porous support.

As preferred hydrorefining catalysts there may be mentioned meso-microporous materials belonging to the M41S class or line of catalysts. M41S line catalysts are meso-microporous materials with high silica contents, and specifically there may be mentioned MCM-41, MCM-48 and MCM-50. The hydrorefining catalyst has a pore size of 15-100 Å, and MCM-41 is particularly preferred. MCM-41 is an inorganic porous non-laminar phase with a hexagonal configuration and pores of uniform size. The physical structure of MCM-41 manifests as straw-like bundles with straw openings (pore cell diameters) in the range of 15-100 angstroms. MCM-48 has cubic symmetry, while MCM-50 has a laminar structure. MCM-41 may also have a structure with pore openings having different meso-microporous ranges. The meso-microporous material may contain metal hydrogenated components consisting of one or more Group 8, 9 or 10 metals, and preferred as metal hydrogenated components are precious metals, especially Group 10 precious metals, and most preferably Pt, Pd or their mixtures.

As regards the hydrorefining conditions, the temperature is preferably 150-350° C. and more preferably 180-250° C., the total pressure is preferably 2859-20,786 kPa (approximately 400-3000 psig), the liquid space velocity is preferably 0.1-5 $hr^{-1}$ and more preferably 0.5-3 $hr^{-1}$, and the hydrogen/oil ratio is preferably 44.5-1780 $m^3/m^3$ (250-10,000 scf/b). These conditions are only for example, and the hydrorefining conditions in the third process may be appropriately selected for different feedstocks and treatment apparatuses, in order to obtain the specified urea adduct value and viscosity index for the treated product obtained after the third process.

The treated product obtained after the third process may be subjected to distillation or the like as necessary for separating removal of certain components.

The lubricating base oil of the invention obtained by the production process described above is not restricted in terms of its other properties so long as the urea adduct value and viscosity index satisfy their respective conditions, but the lubricating base oil of the invention preferably also satisfies the conditions specified below.

The saturated component content of the lubricating base oil of the invention is preferably 90% by mass or greater, more preferably 93% by mass or greater and even more preferably 95% by mass or greater based on the total amount of the lubricating base oil. The proportion of cyclic saturated components among the saturated components is preferably 0.1-50% by mass, more preferably 0.5-40% by mass, even more preferably 1-30% by mass and most preferably 5-20% by mass. If the saturated component content and proportion of cyclic saturated components among the saturated components both satisfy these respective conditions, it will be possible to achieve adequate levels for the viscosity-temperature characteristic and heat and oxidation stability, while additives added to the lubricating base oil will be kept in a sufficiently stable dissolved state in the lubricating base oil so that the functions of the additives can be exhibited at a higher level. In addition, the saturated component content and the proportion of cyclic saturated components among the saturated components satisfying the aforementioned conditions can improve the frictional properties of the lubricating base oil itself, resulting in a greater friction reducing effect and thus increased energy savings.

If the saturated component content is less than 90% by mass, the viscosity-temperature characteristic, heat and oxidation stability and frictional properties will tend to be inadequate. If the proportion of cyclic saturated components among the saturated components is less than 0.1% by mass, the solubility of the additives included in the lubricating base oil will be insufficient and the effective amount of additives kept dissolved in the lubricating base oil will be reduced, making it impossible to effectively achieve the function of the additives. If the proportion of cyclic saturated components among the saturated components is greater than 50% by mass, the efficacy of additives included in the lubricating base oil will tend to be reduced.

According to the invention, a proportion of 0.1-50% by mass cyclic saturated components among the saturated components is equivalent to 99.9-50% by mass acyclic saturated components among the saturated components. Both normal paraffins and isoparaffins are included by the term "acyclic saturated components". The proportions of normal paraffins and isoparaffins in the lubricating base oil of the invention are not particularly restricted so long as the urea adduct value satisfies the condition specified above, but the proportion of isoparaffins is preferably 50-99.9% by mass, more preferably 60-99.9% by mass, even more preferably 70-99.9% by mass and most preferably 80-99.9% by mass based on the total amount of the lubricating base oil. If the proportion of isoparaffins in the lubricating base oil satisfies the aforementioned conditions it will be possible to further improve the viscosity-temperature characteristic and heat and oxidation stability, while additives added to the lubricating base oil will be kept in a sufficiently stable dissolved state in the lubricating base oil so that the functions of the additives can be exhibited at an even higher level.

The saturated component content for the purpose of the invention is the value measured according to ASTM D 2007-93 (units: % by mass).

The proportions of the cyclic saturated components and acyclic saturated components among the saturated components for the purpose of the invention are the naphthene portion (measuring object: monocyclic-hexacyclic naphthenes, units: % by mass) and alkane portion (units: % by mass), respectively, both measured according to ASTM D 2786-91.

The proportion of normal paraffins in the lubricating base oil for the purpose of the invention is the value obtained by analyzing saturated components separated and fractionated based on the method of ASTM D 2007-93 by gas chromatography under the following conditions, and calculating the value obtained by identifying and quantifying the proportion of normal paraffins among those saturated components, with respect to the total amount of the lubricating base oil. For identification and quantitation, a C5-C50 straight-chain normal paraffin mixture sample is used as the reference sample, and the normal paraffin content among the saturated components is determined as the proportion of the total of the peak areas corresponding to each normal paraffin, with respect to the total peak area of the chromatogram (subtracting the peak area for the diluent).

(Gas Chromatography Conditions)

Column: Liquid phase nonpolar column (length: 25 mm, inner diameter: 0.3 mmϕ, liquid phase film thickness: 0.1 μm).

Temperature elevating conditions: 50° C.-400° C. (temperature-elevating rate: 10° C./min).

Carrier gas: helium (linear speed: 40 cm/min)

Split ratio: 90/1

Sample injection amount: 0.5 μL (injection amount of sample diluted 20-fold with carbon disulfide).

The proportion of isoparaffins in the lubricating base oil is the value of the difference between the acyclic saturated components among the saturated components and the normal paraffins among the saturated components, based on the total amount of the lubricating base oil.

Other methods may be used for separation of the saturated components or for compositional analysis of the cyclic saturated components and acyclic saturated components, so long as they provide similar results. As examples of other methods there may be mentioned the method according to ASTM D 2425-93, the method according to ASTM D 2549-91, methods of high performance liquid chromatography (HPLC), and modified foams of these methods.

When the bottom fraction obtained from a fuel oil hydrocracking apparatus is used as the feedstock for the lubricating base oil of the invention, the obtained base oil will have a saturated component content of 90% by mass or greater, a proportion of cyclic saturated components in the saturated components of 30-50% by mass, a proportion of acyclic saturated components in the saturated components of 50-70% by mass, a proportion of isoparaffins in the lubricating base oil of 40-70% by mass and a viscosity index of 100-135 and preferably 120-130, but if the urea adduct value satisfies the conditions specified above it will be possible to drastically improve the effect of the invention, and especially the low-temperature viscosity characteristic, and to obtain a shock absorber fluid that can exhibit sufficient buffer action or damping force even at low temperatures. When a slack wax or Fischer-Tropsch wax having a high wax content (for example, a normal paraffin content of 50% by mass or greater) is used as the feedstock for the lubricating base oil of the invention, the obtained base oil will have a saturated component content of 90% by mass or greater, a proportion of cyclic saturated components in the saturated components of 0.1-40% by mass, a proportion of acyclic saturated components in the saturated components of 60-99.9% by mass, a proportion of isoparaffins in the lubricating base oil of 60-99.9% by mass and a viscosity index of 100-170 and preferably 135-160, but if the urea adduct value satisfies the conditions specified above it will be possible to obtain a lubricating oil composition with very excellent properties in terms of the effect of the invention, and especially the high viscosity index and low-temperature viscosity characteristic.

If the refractive index at 20° C. is represented as $n_{20}$ and the kinematic viscosity at 100° C. is represented as kv100, the value of $n_{20}-0.002\times kv100$ for the lubricating base oil of the invention is preferably 1.435-1.450, more preferably 1.440-1.449, even more preferably 1.442-1.448 and yet more preferably 1.444-1.447. If $n_{20}-0.002\times kv100$ is within the range specified above it will be possible to achieve an excellent viscosity-temperature characteristic and heat and oxidation stability, while additives added to the lubricating base oil will be kept in a sufficiently stable dissolved state in the lubricating base oil so that the functions of the additives can be exhibited at an even higher level. An $n_{20}-0.002\times kv100$ value within the aforementioned range can also improve the frictional properties of the lubricating base oil itself, resulting in a greater friction reducing effect and thus increased energy savings.

If the $n_{20}-0.002\times kv100$ value exceeds the aforementioned upper limit, the viscosity-temperature characteristic, heat and oxidation stability and frictional properties will tend to be insufficient, and the efficacy of additives when added to the lubricating base oil will tend to be reduced. If the $n_{20}-0.002\times kv100$ value is less than the aforementioned lower limit, the solubility of the additives included in the lubricating base oil will be insufficient and the effective amount of additives kept dissolved in the lubricating base oil will be reduced, making it impossible to effectively achieve the functions of the additives.

The 20° C. refractive index ($n_{20}$) for the purpose of the invention is the refractive index measured at 20° C. according to ASTM D1218-92. The kinematic viscosity at 100° C. (kv100) for the purpose of the invention is the kinematic viscosity measured at 100° C. according to JIS K 2283-1993.

The aromatic content of the lubricating base oil of the invention is preferably not greater than 5% by mass, more preferably 0.05-3% by mass, even more preferably 0.1-1% by mass and most preferably 0.1-0.5% by mass based on the total amount of the lubricating base oil. If the aromatic content exceeds the aforementioned upper limit, the viscosity-temperature characteristic, heat and oxidation stability, frictional properties, resistance to volatilization and low-temperature viscosity characteristic will tend to be reduced, while the efficacy of additives when added to the lubricating base oil will also tend to be reduced. The lubricating base oil of the invention may be free of aromatic components, but the solubility of additives can be further increased with an aromatic content of 0.05% by mass or greater.

The aromatic content in this case is the value measured according to ASTM D 2007-93. The aromatic portion normally includes alkylbenzenes and alkylnaphthalenes, as well as anthracene, phenanthrene and their alkylated forms, compounds with four or more fused benzene rings, and heteroatom-containing aromatic compounds such as pyridines, quinolines, phenols, naphthols and the like.

The % $C_P$ value of the lubricating base oil of the invention is preferably 80 or greater, more preferably 82-99, even more preferably 85-98 and most preferably 90-97. If the % $C_P$ value of the lubricating base oil is less than 80, the viscosity-temperature characteristic, heat and oxidation stability and frictional properties will tend to be reduced, while the efficacy of additives when added to the lubricating base oil will also tend to be reduced. If the % $C_P$ value of the lubricating base oil is greater than 99, on the other hand, the additive solubility will tend to be lower.

The % $C_N$ value of the lubricating base oil of the invention is preferably not greater than 20, more preferably not greater than 15, even more preferably 1-12 and most preferably 3-10. If the % $C_N$ value of the lubricating base oil exceeds 20, the viscosity-temperature characteristic, heat and oxidation stability and frictional properties will tend to be reduced. If the % $C_N$ is less than 1, however, the additive solubility will tend to be lower.

The % $C_A$ value of the lubricating base oil is preferably not greater than 0.7, more preferably not greater than 0.6 and even more preferably 0.1-0.5. If the % $C_A$ value of the lubricating base oil exceeds 0.7, the viscosity-temperature characteristic, heat and oxidation stability and frictional properties will tend to be reduced. The % $C_A$ value of the lubricating base oil of the invention may be zero, but the solubility of additives can be further increased with a % $C_A$ value of 0.1 or greater.

The ratio of the % $C_P$ and % $C_N$ values for the lubricating base oil of the invention is % $C_P$/% $C_N$ of preferably 7 or greater, more preferably 7.5 or greater and even more preferably 8 or greater. If the % $C_P$/% $C_N$ ratio is less than 7, the viscosity-temperature characteristic, heat and oxidation stability and frictional properties will tend to be reduced, while the efficacy of additives when added to the lubricating base oil will also tend to be reduced. The % $C_P$/% $C_N$ ratio is preferably not greater than 200, more preferably not greater than 100, even more preferably not greater than 50 and most preferably not greater than 25. The additive solubility can be further increased if the % $C_P$/% $C_N$ ratio is not greater than 200.

The % $C_P$, % $C_N$ and % $C_A$ values for the purpose of the invention are, respectively, the percentage of paraffinic carbons with respect to total carbon atoms, the percentage of naphthenic carbons with respect to total carbons and the percentage of aromatic carbons with respect to total carbons, as determined by the methods of ASTM D 3238-85 (n-d-M ring analysis). That is, the preferred ranges for % $C_P$, % $C_N$ and % $C_A$ are based on values determined by these methods, and for example, % $C_N$ may be a value exceeding 0 according to these methods even if the lubricating base oil contains no naphthene portion.

The iodine value of the lubricating base oil of the invention is preferably not greater than 0.5, more preferably not greater than 0.3 and even more preferably not greater than 0.15, and although it may be less than 0.01, it is preferably 0.001 or greater and more preferably 0.05 or greater in consideration of economy and achieving a significant effect. Limiting the iodine value of the lubricating base oil to not greater than 0.5 can drastically improve the heat and oxidation stability. The "iodine value" for the purpose of the invention is the iodine value measured by the indicator titration method according to JIS K 0070, "Acid Values, Saponification Values, Iodine Values, Hydroxyl Values And Unsaponification Values Of Chemical Products".

The sulfur content in the lubricating base oil of the invention will depend on the sulfur content of the feedstock. For example, when using a substantially sulfur-free feedstock as for synthetic wax components obtained by Fischer-Tropsch reaction, it is possible to obtain a substantially sulfur-free lubricating base oil. When using a sulfur-containing feedstock, such as slack wax obtained by a lubricating base oil refining process or microwax obtained by a wax refining process, the sulfur content of the obtained lubricating base oil will normally be 100 ppm by mass or greater. From the viewpoint of further improving the heat and oxidation stability and reducing sulfur, the sulfur content in the lubricating base oil of the invention is preferably not greater than 10 ppm by mass, more preferably not greater than 5 ppm by mass and even more preferably not greater than 3 ppm by mass.

From the viewpoint of cost reduction it is preferred to use slack wax or the like as the feedstock, in which case the sulfur content of the obtained lubricating base oil is preferably not greater than 50 ppm by mass and more preferably not greater than 10 ppm by mass. The sulfur content for the purpose of the invention is the sulfur content measured according to JIS K 2541-1996.

The nitrogen content in the lubricating base oil of the invention is not particularly restricted, but is preferably not greater than 5 ppm by mass, more preferably not greater than 3 ppm by mass and even more preferably not greater than 1 ppm by mass. If the nitrogen content exceeds 5 ppm by mass, the heat and oxidation stability will tend to be reduced. The nitrogen content for the purpose of the invention is the nitrogen content measured according to JIS K 2609-1990.

The kinematic viscosity of the lubricating base oil according to the invention, as the kinematic viscosity at 100° C., is preferably 1.5-20 $mm^2/s$ and more preferably 2.0-11 $mm^2/s$. A kinematic viscosity at 100° C. of lower than 1.5 $mm^2/s$ for the lubricating base oil is not preferred from the standpoint of evaporation loss. If it is attempted to obtain a lubricating base oil having a kinematic viscosity at 100° C. of greater than 20 $mm^2/s$, the yield will be reduced and it will be difficult to increase the cracking severity even when using a heavy wax as the feedstock.

According to the invention, a lubricating base oil having a kinematic viscosity at 100° C. in the following range is preferably used after fractionation by distillation or the like.

(I) A lubricating base oil with a kinematic viscosity at 100° C. of at least 1.5 $mm^2/s$ and less than 3.5 $mm^2/s$, and more preferably 2.0-3.0 $mm^2/s$.

The kinematic viscosity at 40° C. of the lubricating base oil of the invention is preferably 6.0-80 $mm^2/s$ and more preferably 8.0-50 $mm^2/s$. According to the invention, a lube-oil distillate having a kinematic viscosity at 40° C. in one of the following ranges is preferably used after fractionation by distillation or the like. The range for the viscosity index of the lubricating base oil is 100 or greater, preferably 110 or greater, more preferably 120 or greater and even more preferably 125 or greater, and preferably not greater than 150, more preferably not greater than 140 and even more preferably not greater than 130.

The lubricating base oil (I) having a urea adduct value and viscosity index satisfying the respective conditions specified above can achieve high levels of both the viscosity-temperature characteristic and low-temperature viscosity characteristic compared to conventional lubricating base oils of the same viscosity grade, and in particular it has an excellent low-temperature viscosity characteristic whereby the viscosity resistance or stirring resistance can notably reduced. Moreover, by including a pour point depressant it is possible to lower the BF viscosity at −40° C. to 2000 mPa·s or smaller. The BF viscosity at −40° C. is the viscosity measured according to JPI-5S-26-99.

The refractive index at 20° C. of the lubricating base oil of the invention will depend on the viscosity grade of the lubricating base oil, and for example, the refractive index of the lubricating base oil (I) is preferably not greater than 1.455, more preferably not greater than 1.453 and even more preferably not greater than 1.451. If the refractive index exceeds the aforementioned upper limit, the viscosity-temperature characteristic, heat and oxidation stability, resistance to volatilization and low-temperature viscosity characteristic of the lubricating base oil will tend to be reduced, while the efficacy of additives when added to the lubricating base oil will also tend to be reduced.

The pour point of the lubricating base oil of the invention is not particularly restricted, and for example, the pour point of the lubricating base oil (I) is preferably not higher than −10° C., more preferably not higher than −12.5° C. and even more preferably not higher than −15° C. If the pour point exceeds the upper limit specified above, the low-temperature flow properties of a lubricating oil employing the lubricating base oil will tend to be reduced. The pour point for the purpose of the invention is the pour point measured according to JIS K 2269-1987.

There are no particular restrictions on the BF viscosity at −40° C. of the lubricating base oil of the invention, and for example, the BF viscosity at −40° C. of the lubricating base oil (I) is more preferably not greater than 8000 mPa·s, even more preferably not greater than 6000 mPa·s and most preferably not greater than 5000 mPa·s. If the BF viscosity at −40° C. exceeds the upper limit specified above, the low-temperature flow properties of a lubricating oil employing the lubricating base oil will tend to be reduced.

The density at 15° C. ($\rho_{15}$) of the lubricating base oil of the invention will also depend on the viscosity grade of the lubricating base oil, but it is preferably not greater than the value of $\rho$ as represented by the following formula (1), i.e., $\rho_{15} \leq \rho$.

$$\rho = 0.0025 \times kv100 + 0.816 \quad (1)$$

In this equation, kv100 represents the kinematic viscosity at 100° C. ($mm^2/s$) of the lubricating base oil.

If $\rho_{15} > \rho$, the viscosity-temperature characteristic, heat and oxidation stability, resistance to volatilization and low-temperature viscosity characteristic of the lubricating base oil will tend to be reduced, while the efficacy of additives when added to the lubricating base oil will also tend to be reduced.

For example, the value of $\rho_{15}$ for lubricating base oil (I) is preferably not greater than 0.825 and more preferably not greater than 0.820.

The density at 15° C. for the purpose of the invention is the density measured at 15° C. according to JIS K 2249-1995.

The aniline point (AP (° C.)) of the lubricating base oil of the invention is preferably greater than or equal to the value of A as represented by the following formula (2), i.e., AP≤A.

$$A = 4.3 \times kv100 + 100 \quad (2)$$

In this equation, kv100 represents the kinematic viscosity at 100° C. ($mm^2/s$) of the lubricating base oil.

If AP<A, the viscosity-temperature characteristic, heat and oxidation stability, resistance to volatilization and low-temperature viscosity characteristic of the lubricating base oil will tend to be reduced, while the efficacy of additives when added to the lubricating base oil will also tend to be reduced.

For example, the aniline point of the lubricating base oil (I) is preferably 108° C. or higher and more preferably 110° C. or higher. The aniline point for the purpose of the invention is the aniline point measured according to JIS K 2256-1985.

The NOACK evaporation of the lubricating base oil of the invention is not particularly restricted, and for example, the NOACK evaporation of the lubricating base oil (I) is preferably not greater than 50% by mass, more preferably not greater than 45% by mass and even more preferably not greater than 40% by mass, and also preferably 20% by mass or greater, preferably 25% by mass or greater and even more preferably 30% by mass or greater. If the NOACK evaporation is below the aforementioned lower limit it will tend to be difficult to improve the low-temperature viscosity characteristic. If the NOACK evaporation exceeds these upper limits, the evaporation loss of the lubricating oil will be increased and a deficiency of operating oil in the shock absorber will result. The NOACK evaporation for the purpose of the invention is the evaporation loss as measured according to ASTM D 5800-95.

The distillation properties of the lubricating base oil of the invention are preferably an initial boiling point (IBP) of 290-440° C. and a final boiling point (FBP) of 430-580° C. in gas chromatography distillation, and rectification of one or more fractions selected from among fractions in this distillation range can yield a lubricating base oil (I) having the aforementioned preferred viscosity ranges.

For example, for the distillation properties of the lubricating base oil (I), the initial boiling point (IBP) is preferably 260-340° C., more preferably 270-330° C. and even more preferably 280-320° C. The 10% running point (T10) is preferably 310-390° C., more preferably 320-380° C. and even more preferably 330-370° C. The 50% running point (T50) is preferably 340-440° C., more preferably 360-430° C. and even more preferably 370-420° C. The 90% running point (T90) is preferably 405-465° C., more preferably 415-455° C. and even more preferably 425-445° C. The final boiling point (FBP) is preferably 430-490° C., more preferably 440-480° C. and even more preferably 450-490° C. T90-T10 is preferably 60-140° C., more preferably 70-130° C. and even more preferably 80-120° C. FBP-IBP is preferably 140-200° C., more preferably 150-190° C. and even more preferably 160-180° C. T10-IBP is preferably 40-100° C., more preferably 50-90° C. and even more preferably 60-80° C. FBP-T90 is preferably 5-60° C., more preferably 10-55° C. and even more preferably 15-50° C.

By setting IBP, T10, T50, T90, FBP, T90-T10, FBP-IBP, T10-IBP and FBP-T90 of the lubricating base oil (I) to within the preferred ranges specified above, it is possible to further improve the low temperature viscosity and further reduce the evaporation loss. If the distillation ranges for T90-T10, FBP-IBP, T10-IBP and FBP-T90 are too narrow, the lubricating base oil yield will be poor resulting in low economy.

The IBP, T10, T50, T90 and FBP values for the purpose of the invention are the running points measured according to ASTM D 2887-97.

The residual metal content in the lubricating base oil of the invention derives from metals in the catalyst or feedstocks that have become unavoidable contaminants during the production process, and it is preferred to thoroughly remove such residual metal contents. For example, the Al, Mo and Ni contents are preferably not greater than 1 ppm by mass each. If the metal contents exceed the aforementioned upper limit, the functions of additives in the lubricating base oil will tend to be inhibited.

The residual metal content for the purpose of the invention is the metal content as measured according to JPI-5S-38-2003.

The lubricating base oil of the invention preferably exhibits a RBOT life as specified below, correlating with its kinematic viscosity. For example, the RBOT life for the lubricating base oil (I) is preferably 290 min or greater, more preferably 300 min or greater and even more preferably 310 min or greater. If the RBOT life of the lubricating base oil is less than the specified lower limit, the viscosity-temperature characteristic and heat and oxidation stability of the lubricating base oil will tend to be reduced, while the efficacy of additives when added to the lubricating base oil will also tend to be reduced.

The RBOT life for the purpose of the invention is the RBOT value as measured according to JIS K 2514-1996, for a composition obtained by adding a phenol-based antioxidant (2,6-di-tert-butyl-p-cresol: DBPC) at 0.2% by mass to the lubricating base oil.

The shock absorber fluid according to the invention may be used alone as a lubricating base oil according to the invention, or the lubricating base oil of the invention may be combined with one or more other base oils. When the lubricating base oil of the invention is combined with another base oil, the proportion of the lubricating base oil of the invention of the total mixed base oil is preferably at least 30% by mass, more preferably at least 50% by mass and even more preferably at least 70% by mass.

There are no particular restrictions on the other base oil used in combination with the lubricating base oil of the invention, and as examples of mineral oil base oils there may be mentioned solvent refined mineral oils, hydrocracked mineral oil, hydrorefined mineral oils and solvent dewaxed base oils having kinematic viscosities at 100° C. of 1-100 $mm^2/s$.

As synthetic base oils there may be mentioned poly-α-olefins and their hydrogenated forms, isobutene oligomers and their hydrogenated forms, isoparaffins, alkylbenzenes, alkylnaphthalenes, diesters (ditridecyl glutarate, di-2-ethylhexyl adipate, diisodecyl adipate, ditridecyl adipate, di-2-ethylhexyl sebacate and the like), polyol esters (trimethylolpropane caprylate, trimethylolpropane pelargonate, pentaerythritol 2-ethylhexanoate, pentaerythritol pelargonate and the like), polyoxyalkylene glycols, dialkyldiphenyl ethers and polyphenyl ethers, among which poly-α-olefins are preferred. As typical poly-α-olefins there may be mentioned C2-C32 and preferably C6-C16 α-olefin oligomers or co-oligomers (1-octene oligomer, decene oligomer, ethylene-propylene co-oligomers and the like), and their hydrogenated forms.

There are no particular restrictions on the method for producing poly-α-olefins, and as an example there may be mentioned a process wherein an α-olefin is polymerized in the presence of a polymerization catalyst such as a Friedel-Crafts catalyst comprising a complex of aluminum trichloride or boron trifluoride with water, an alcohol (ethanol, propanol, butanol or the like) and a carboxylic acid or ester.

The shock absorber fluid according to the invention preferably further comprises a viscosity index improver. The viscosity index improver used may be any compound commonly used as a lubricating oil viscosity index improver, and as examples there may be mentioned non-dispersant viscosity index improvers including polymers or copolymers of one or more monomers selected from among various methacrylic acid esters, or hydrogenated forms of the same, dispersant viscosity index improvers obtained by further copolymerizing various nitrogen compound-containing methacrylic acid esters, non-dispersant or dispersant ethylene-α-olefin copolymers (with propylene, 1-butene, 1-pentene and the like as examples of α-olefins) or their hydrogenated forms of the same, polyisobutylene or its hydrogenated forms, hydrogenated styrene-diene copolymer, styrene-maleic anhydride ester copolymer, polyalkylstyrenes and the like.

The weight-average molecular weight of the viscosity index improver may be, for example in the case of a dispersant or non-dispersant polymethacrylate, usually 5,000-1,000,000 and preferably 100,000-900,000, in the case of polyisobutylene or its hydrogenated form, usually 800-500,000 and preferably 1,000-400,000, and in the case of ethylene-α-olefin copolymer or its hydrogenated form, usually 800-500,000 and preferably 3,000-200,000.

According to the invention, any one or more compounds selected from among the viscosity index improvers mentioned above may be used in any desired amounts.

Of these viscosity index improvers, it is preferred to use polymethacrylate-based viscosity index improvers from the viewpoint of achieving an excellent viscosity index improving effect and low-temperature viscosity characteristic improving effect. The weight-average molecular weight of the polymethacrylate-based viscosity index improver is preferably 10,000-300,000, more preferably 40,000-250,000 and even more preferably 100,000-200,000. If the weight-average molecular weight of the polymethacrylate-based viscosity index improver is above the aforementioned lower limit it will be possible to obtain a higher viscosity index improving effect and low-temperature viscosity characteristic improving effect, and if it is below the aforementioned upper limit, the obtained composition will have excellent shear stability.

The viscosity index improver content will usually be 0.1-20% by mass based on the composition weight, but according to the invention it is preferably not greater than 2.5% by mass, more preferably not greater than 2% by mass, even more preferably not greater than 1.5% by mass and most preferably not greater than 1% by mass, and preferably 0.01% by mass or greater or more preferably 0.1% by mass or greater, as the amount of polymer in the viscosity index improver based on the total amount of the shock absorber fluid. Limiting the amount of polymer in the viscosity index improver to not greater than 2.5% by mass can yield a composition with excellent shear stability, and ensuring at least 0.01% by mass will further increase the low-temperature viscosity characteristic improving effect.

Any desired additives that are used in shock absorber fluids may be added to the shock absorber fluid according to the invention, in addition to the aforementioned viscosity index improver. As specific lubricating oil additives there may be mentioned antioxidants, ashless dispersants, extreme-pressure agents, anti-wear agents, friction modifiers, pour point depressants, metal deactivating agents, antifoaming agents, metal-based detergents, corrosion inhibitors, rust-preventive agents, demulsifiers, seal swelling agents, coloring agents and the like. These additives may be used alone or in combinations of two or more.

As antioxidants there may be used any compounds commonly used as antioxidants in lubricating oils, and as examples there may be mentioned phenol-based antioxidants such as 2,6-di-tert-butyl-p-cresol, 4,4'-methylenebis(2,6-di-tert-butylphenol), octyl-3-(3,5-di-tert-butyl-4-hydroxyphenyl)propionate and 3-methyl-5-tert-butyl-4-hydroxyphenyl-substituted fatty acid esters, and amine-based antioxidants such as phenyl-α-naphthylamine, alkylphenyl-α-naphthylamine and dialkyldiphenylamine.

These antioxidants may be added to the shock absorber fluid according to the invention in a range of generally 0.01-5% by mass based on the total amount of the shock absorber fluid.

As ashless dispersants there may be used any compounds commonly used as ashless dispersants in lubricating oils, and as examples there may be mentioned succiniimides, benzylamines and polyamines with C40-C400 alkyl or alkenyl groups, as well as derivatives thereof modified with boron compounds, phosphorus compounds, sulfur compounds, oxygen-containing organic compounds and the like. According to the invention, it is preferred to add a bis-type succiniimide, among succiniimides with at least one alkyl or alkenyl group with a number-average molecular weight of 700-2500 and preferably 900-1500.

The ashless dispersant may be added to the shock absorber fluid according to the invention in a range of generally 0.01-20% by mass based on the total amount of the shock absorber fluid, but according to the invention it is preferably 0.01-5% by mass, more preferably not greater than 1% by mass and most preferably not greater than 0.5% by mass.

As anti-wear agents there may be used any compounds commonly used as anti-wear agents for lubricating oils, and as examples there may be mentioned phosphorus and/or sulfur-containing anti-wear agents, including (thio)phosphoric acid esters, (thio)phosphorous acid esters, derivatives of the foregoing, metal salts of the foregoing, amine salts of the foregoing, and sulfur-containing compounds such as disulfides, olefin sulfides, sulfurized fats and oils, dithiocarbamates, zinc dithiocarbaminates and the like. According to the invention it is preferred to add a zinc dialkyldithiophosphate or a phosphorous acid ester and/or phosphoric acid ester with a C1-C30, preferably a C4-C24 and more preferably a C8-C20 alkyl or alkenyl group, and it is particularly preferred to add a phosphorous acid ester with a C8-C20 alkyl or alkenyl group (for example, di(2-ethylhexyl) hydrogenphosphite or dioleyl hydrogenphosphite).

These anti-wear agents may be added to the shock absorber fluid according to the invention in a range of generally 0.01-5% by mass based on the total amount of the shock absorber fluid.

As friction modifiers there may be used any compounds commonly employed as friction modifiers for lubricating oils, and as examples there may be mentioned friction modifiers such as aliphatic alcohols, aliphatic ethers, aliphatic amines, fatty acids and fatty acid esters having at least one C6-C30 alkyl or alkenyl, and especially C6-C30 straight-chain alkyl or straight-chain alkenyl group in the molecule, or nitrogen-containing fatty acids such as sarcosine, as well as their derivatives. According to the invention it is preferred to use a fatty acid with a C12-C20 alkyl or alkenyl group or a derivative thereof, and it is particularly preferred to use an ester of such a fatty acid and a polyhydric alcohol (for example, glycerin oleate). These friction modifiers may be added in a range of generally 0.01-5% by mass based on the total amount of the shock absorber fluid.

As pour point depressants there may be used any compounds commonly employed as flow property enhancers for lubricating oils, and as examples there may be mentioned polymethacrylate-based flow property improvers.

As metal deactivating agents there may be mentioned imidazoline, pyrimidine derivatives, alkylthiadiazoles, mercaptobenzothiazole, benzotriazole and derivatives thereof, 1,3,4-thiadiazolepolysulfide, 1,3,4-thiadiazolyl-2,5-bisdialkyl dithiocarbamates, 2-(alkyldithio)benzoimidazoles and β-(o-carboxybenzylthio)propionitrile.

As examples of antifoaming agents there may be mentioned silicone, fluorosilicone and fluoroalkyl ether.

As metal-based detergents there may be mentioned sulfonates, phenates, salicylates and phosphonates of alkali metals or alkaline earth metals.

As examples of corrosion inhibitors there may be mentioned benzotriazole-based, tolyltriazole-based, thiadiazole-based and imidazole-based compounds.

As examples of rust-preventive agents there may be mentioned petroleum sulfonates, alkylbenzene sulfonates, dinonylnaphthalene sulfonates, alkenylsuccinic acid esters and polyhydric alcohol esters.

As examples of demulsifiers there may be mentioned polyalkylene glycol-based nonionic surfactants such as polyoxyethylenealkyl ethers, polyoxyethylenealkylphenyl ethers and polyoxyethylenealkylnaphthyl ethers.

When such additives are added to a hydraulic oil for a shock absorber according to the invention, the contents will normally be selected in ranges of 0.005-5% by mass for pour point depressants, metal-based detergents, corrosion inhibitors, rust-preventive agents and demulsifiers, 0.005-1% by mass for metal deactivating agents, and 0.0005-1% by mass for antifoaming agents, based on the total amount of the shock absorber fluid.

The kinematic viscosity of the hydraulic oil for a shock absorber according to the invention is not particularly restricted, but the kinematic viscosity at 40° C. will normally be 3-60 $mm^2/s$, preferably 6-20 $mm^2/s$ and most preferably 8-15 $mm^2/s$.

The Brookfield viscosity at −40° C. of the hydraulic oil for a shock absorber according to the invention is preferably not greater than 2000 mPa·s, more preferably not greater than 1700 mPa·s, even more preferably not greater than 1400 mPa·s and most preferably not greater than 1200 mPa·s, in order to obtain satisfactory buffer action or damping force even at this temperature.

When subjected to shear under the conditions of The Japan Petroleum Institute method JPI-5S-29-06, the hydraulic oil for a shock absorber according to the invention has a reduction rate of a kinematic viscosity at 100° C. after shear, with respect to the kinematic viscosity at 100° C. before shear, of preferably not greater than 10%, more preferably not greater than 8% and even more preferably not greater than 6%. The kinematic viscosity reduction rate after shear is the value of the difference between the kinematic viscosity at 100° C. before shear and the kinematic viscosity at 100° C. after shear, divided by the kinematic viscosity at 100° C. before shear and multiplied by 100.

EXAMPLES

The present invention will now be explained in greater detail based on examples and comparative examples, with the understanding that these examples are in no way limitative on the invention.

Example 1

For Example 1, first a fraction separated by vacuum distillation in a process for refining of solvent refined base oil was subjected to solvent extraction with furfural and then hydrotreating, which was followed by solvent dewaxing with a methyl ethyl ketone-toluene mixed solvent. The crude wax portion (hereunder, "WAX1") removed during solvent dewaxing and obtained as slack wax was used as the feedstock oil for the lubricating base oil. The properties of WAX1 are shown in Table 1.

WAX1 was then used as the feedstock oil for hydrotreatment with a hydrotreatment catalyst. The reaction temperature and liquid space velocity during this time were controlled for a cracking severity of not greater than 10% by mass for the normal paraffins in the feedstock oil. The sulfur content of the treated product after hydrotreatment was not greater than 10 ppm by mass and the nitrogen content was not greater than 3 ppm.

Next, the treated product obtained from the hydrotreatment was subjected to hydrodewaxing in a temperature range of 315° C.-325° C. using a zeolite-based hydrodewaxing catalyst adjusted to a precious metal content of 0.1-5% by mass.

The treated product (raffinate) obtained by this hydrodewaxing was subsequently treated by hydrorefining using a hydrorefining catalyst. Next, the gas and heavy portions were separated by distillation to obtain a lubricating base oil D1 having the composition and properties shown in Table 2. In Table 2, the row headed "Proportion of normal paraffin-derived components in urea adduct" contains the values obtained by gas chromatography of the urea adduct obtained during measurement of the urea adduct value (same hereunder).

Example 2

For Example 2, first a fraction separated by vacuum distillation in a process for refining of solvent refined base oil was subjected to solvent extraction with furfural and then hydrotreating, which was followed by solvent dewaxing with a methyl ethyl ketone-toluene mixed solvent. The refined wax portion (hereunder, "WAX2") obtained by further deoiling the wax that was removed during solvent dewaxing and obtained as slack wax to an oil content of 5% by mass was used as the feedstock oil for the lubricating base oil. The properties of WAX2 are shown in Table 1.

Hydrotreatment, hydrodewaxing, hydrorefining and distillation were carried out in the same manner as in Example 1, except for using WAX2 instead of WAX1, to obtain a lubricating base oil D2 having the composition and properties listed in Table 2.

Example 3

For Example 3 there was used an FT wax (hereunder, "WAX3") with a paraffin content of 95% by mass and a carbon number distribution of 20-80, obtained by Fischer-Tropsch synthesis. The properties of WAX3 are shown in Table 1.

Hydrotreatment, hydrodewaxing, hydrorefining and distillation were carried out in the same manner as in Example 1, except for using WAX3 instead of WAX1, to obtain a lubricating base oil D3 having the composition and properties listed in Table 2.

Table 3 shows the properties of a conventional hydrocracked mineral oil R1 and a conventional solvent refined mineral oil R2, as Comparative Examples 1 and 2.

TABLE 1

| | Name of starting WAX | | |
|---|---|---|---|
| | WAX1 | WAX2 | WAX3 |
| Kinematic viscosity at 100° C., $mm^2/s$ | 6.3 | 6.8 | 5.8 |
| Melting point, ° C. | 53 | 58 | 70 |
| Oil content, % by mass | 19.9 | 6.3 | <1 |
| Sulfur content, ppm by mass | 1900 | 900 | <0.2 |

TABLE 2

| | | Example 1 | Example 2 | Example 3 |
|---|---|---|---|---|
| Name of base oil | | D1 | D2 | D3 |
| Feedstock | | WAX1 | WAX2 | WAX3 |
| Urea adduct value (% by mass) | | 1.55 | 1.45 | 1.42 |
| Proportion of normal paraffin-derived components in urea adduct (% by mass) | | 13.6 | 14.5 | 13.8 |
| Straight-chain carbon concentration in specific components (% by mass) | | 0.01 | 0.02 | 0.01 |
| Base oil composition (based on total amount of base oil) | Saturated components (% by mass) | 99.6 | 99.8 | 99.8 |
| | Aromatic components (% by mass) | 0.2 | 0.1 | 0.2 |
| | Polar compound components (% by mass) | 0.2 | 0.1 | 0 |
| Saturated components (based on total amount of saturated components) | Cyclic saturated components (% by mass) | 8.7 | 8.4 | 8.0 |
| | Acyclic saturated components (% by mass) | 91.3 | 91.6 | 92.0 |
| Acyclic saturated components in base oil (based on total amount of base oil) | Normal paraffins (% by mass) | 0.2 | 0.2 | 0.2 |
| | Isoparaffins (% by mass) | 90.8 | 91.2 | 91.2 |
| Acyclic saturated components (based on total acyclic saturated content) | Normal paraffins (% by mass) | 0.2 | 0.2 | 0.2 |
| | Isoparaffins (% by mass) | 99.8 | 99.8 | 99.8 |
| Sulfur content (ppm by mass) | | <10 | <10 | <10 |
| Nitrogen content (ppm by mass) | | <3 | <3 | <3 |
| Kinematic viscosity ($mm^2/s$) | 40° C. | 10.00 | 9.88 | 9.95 |
| | 100° C. | 2.796 | 2.788 | 2.791 |
| Viscosity index | | 128 | 125 | 124 |
| Density at 15° C. ($g/cm^3$) | | 0.812 | 0.815 | 0.8170 |
| Pour point (° C.) | | −32.5 | −30 | −30 |
| Freezing point (° C.) | | −32 | −31 | −31 |
| Iodine value | | 0 | 0 | 0 |
| Aniline point (° C.) | | 112.0 | 111.5 | 112.2 |
| Distillation properties | IBP (° C.) | 294 | 292 | 293 |
| | T10 (° C.) | 351 | 350 | 353 |
| | T50 (° C.) | 394 | 393 | 392 |
| | T90 (° C.) | 425 | 420 | 424 |
| | FBP (° C.) | 451 | 448 | 450 |
| CCS viscosity at −35° C. (mPa · s) | | <1400 | <1400 | <1400 |
| BF viscosity at −40° C. (mPa · s) | | — | 3830 | — |

TABLE 3

| | | Comp. Ex. 1 | Comp. Ex. 2 |
|---|---|---|---|
| Name of base oil | | R1 | R2 |
| Feedstock | | — | — |
| Urea adduct value, % by mass | | 5.2 | 7.1 |
| Proportion of normal paraffin-derived components in urea adduct (% by mass) | | 24.5 | 44.5 |
| Straight-chain carbon concentration in specific components (% by mass) | | — | — |
| Base oil composition (based on total amount of base oil) | Saturated components (% by mass) | 93.8 | 82.9 |
| | Aromatic components (% by mass) | 6.0 | 16.8 |
| | Polar compound components (% by mass) | 0.2 | 0.3 |
| Saturated components (based on total amount of saturated components) | Cyclic saturated components (% by mass) | 46.5 | >40 |
| | Acyclic saturated components (% by mass) | 53.5 | <60 |
| Acyclic saturated components in base oil (based on total amount of base oil) | Normal paraffins (% by mass) | 0.2 | 0.2 |
| | Isoparaffins (% by mass) | 53.2 | 59.8 |
| Acyclic saturated components (based on total amount of acyclic saturated content) | Normal paraffins (% by mass) | 0.5 | 0.8 |
| | Isoparaffins (% by mass) | 99.5 | 99.2 |
| Sulfur content (ppm by mass) | | <1 | 980 |
| Nitrogen content (ppm by mass) | | <3 | <3 |
| Kinematic viscosity ($mm^2/s$) | 40° C. | 9.40 | 6.71 |
| | 100° C. | 2.60 | 2.04 |
| Viscosity index | | 109 | 93 |
| Density at 15° C. ($g/cm^3$) | | 0.829 | 0.842 |
| Pour point (° C.) | | −27.5 | −25 |
| Freezing point (° C.) | | −29 | −27 |
| Iodine value | | 5.1 | 3.3 |
| Aniline point (° C.) | | 104 | 87 |
| Distillation properties | IBP (° C.) | 243 | 242 |
| | T10 (° C.) | 312 | 289 |
| | T50 (° C.) | 377 | 337 |
| | T90 (° C.) | 418 | 375 |
| | FBP (° C.) | 492 | 424 |
| CCS viscosity at −35° C. (mPa · s) | | <1400 | — |

Examples 4-8, Comparative Examples 3-8

For Examples 4-8 and Comparative Examples 3-8, the lubricating base oils D1, R1, R2 and the lubricating base oil R3 listed below, as well as the additives mentioned below, were used to prepare shock absorber fluids having the compositions listed in Tables 4 and 5.

Lubricating base oil R3: Petroleum-based solvent (kinematic viscosity at 40° C.: 3.2 $mm^2/s$, density at 15° C.: 0.82 $g/cm^3$)

Viscosity index improver A: Polymethacrylate-based viscosity index improver (weight-average molecular weight: 160,000, polymer content: 65% by mass)

Viscosity index improver B: Polymethacrylate-based viscosity index improver (weight-average molecular weight: 50,000, polymer content: 75% by mass)

Viscosity index improver C: Polymethacrylate-based viscosity index improver (weight-average molecular weight: 20,000, polymer content: 75% by mass)

Additive package: Mixture of succinimide dispersant, di(2-ethylhexyl) hydrogenphosphite, glycerin monooleate.

Each of the shock absorber fluids obtained in Examples 4-8 and Comparative Examples 3-8 was subjected to the following test.

(Measurement of Brookfield Viscosity)

The Brookfield viscosity (BF viscosity) at −40° C. was measured by the method of JPI-5S-26-99. The obtained results are shown in Tables 4 and 5.

(Shear Stability Test)

A shear stability test was conducted according to the method of JPI-5S-29-06 with conditions of 10 kHz, 28 μm, 1 hour, and the reduction rate of the kinematic viscosity at 100° C. was calculated from the kinematic viscosity at 100° C. before the shear test and the kinematic viscosity at 100° C. of the test oil after the shear test. The obtained results are shown in Tables 4 and 5. A smaller kinematic viscosity reduction rate indicates more excellent shear stability, and maintains the kinematic viscosity necessary as a hydraulic oil for a shock absorber even under severe conditions and helps to minimize reduction in the damping force of the shock absorber due to reduced kinematic viscosity.

(Foaming Test)

A foaming test was conducted at 25° C. by the method of JIS K2518, and the foaming volume (ml) and time until disappearance of bubbles (second) were measured. The obtained results are shown in Tables 4 and 5. A smaller foaming volume and shorter defoaming time indicates that a more excellent composition can be obtained that, when used as a hydraulic oil for a shock absorber, has greater resistance to loss of damping force of the shock absorber.

TABLE 4

| | | Example 4 | Example 5 | Example 6 | Example 7 | Example 8 |
|---|---|---|---|---|---|---|
| Compositions of lubricating base oils (% by mass) | Base oil D1 | 100 | 100 | 100 | 100 | 100 |
| | Base oil R1 | — | — | — | — | — |
| | Base oil R2 | — | — | — | — | — |
| | Base oil R3 | — | — | — | — | — |
| Shock absorber fluid composition (% by mass) | Lubricating base oil | | | | | |
| | Viscosity index improver A | — | 1 | 2 | — | — |
| | Viscosity index improver B | — | — | — | 2 | — |
| | Viscosity index improver C | — | — | — | — | 3 |
| | Other additives | — | 3.3 | 3.3 | 3.3 | 3.3 |
| Kinematic viscosity ($mm^2/s$) | 40° C. | 10.0 | 11.86 | 12.81 | 12.2 | 12.14 |
| | 100° C. | 2.8 | 3.284 | 3.605 | 3.382 | 3.372 |
| Viscosity index | | 128 | 156 | 179 | 162 | 155 |
| BF viscosity at −40° C. (mPa · s) | | — | 1100 | 1500 | 1480 | 1500 |
| Shear Stability test | Reduction rate of kinematic viscosity at 100° C. (%) | — | 4.8 | 8.1 | 2.5 | 2.2 |
| Foaming test | Foaming volume at 25° C. (ml) | 10 | 10 | 20 | 24 | 26 |
| | Defoaming time (second) | 12 | 12 | 22 | 29 | 30 |

TABLE 5

| | | Comp. Ex. 3 | Comp. Ex. 4 | Comp. Ex. 5 | Comp. Ex. 6 | Comp. Ex. 7 | Comp. Ex. 8 |
|---|---|---|---|---|---|---|---|
| Compositions of lubricating base oils (% by mass) | Base oil D3 | — | — | — | — | — | — |
| | Base oil R1 | 100 | — | 100 | 100 | 100 | 85 |
| | Base oil R2 | — | 100 | — | — | — | — |
| | Base oil R3 | — | — | — | — | — | 15 |
| Shock absorber fluid composition (% by mass) | Lubricating base oil | | | | | | |
| | Viscosity index improver A | — | — | 1 | — | — | 3.4 |
| | Viscosity index improver B | — | — | — | 2 | — | — |
| | Viscosity index improver C | — | — | — | — | 3 | — |
| | Other additives | — | — | 3.3 | 3.3 | 3.3 | 3.2 |
| Kinematic viscosity ($mm^2/s$) | 40° C. | 9.4 | 6.7 | 11.12 | 11.45 | 12.35 | 12.03 |
| | 100° C. | 2.6 | 2.0 | 3.069 | 3.159 | 3.107 | 3.599 |
| Viscosity index | | 109 | 93 | 141 | 147 | 141 | 205 |
| BF viscosity at −40° C. (mPa · s) | | — | — | 2050 | 2000 | 2200 | 1300 |
| Shear stability test | Reduction rate of kinematic viscosity at 100° C. (%) | — | — | 5.2 | 2.6 | 2.3 | 13.2 |
| Foaming test | Foaming volume at 25° C. (ml) | 25 | 45 | 25 | 22 | 27 | 20 |
| | Defoaming time (second) | 28 | 120 | 26 | 25 | 28 | 16 |

As clearly seen by the results in Tables 4 and 5, the shock absorber fluids of Examples 4-8 had high viscosity indexes and excellent low-temperature viscosity characteristics, while the shear stabilities were also highly superior. When the same test was conducted using the lubricating base oil D2 or D3 to prepare the shock absorber fluid instead of the lubricating base oil D1 of Examples 4-8, these shock absorber fluids also had high viscosity indexes and excellent low-temperature viscosity characteristics, while their shear stabilities were highly superior as well.

The invention claimed is:

1. A shock absorber fluid comprising a lubricating base oil that has a urea adduct value of not greater than 4% by mass, a viscosity index of 100 or greater, and comprising a saturated component that contains cyclic and acyclic components, wherein the saturated component content is 90% or greater based on the total weight of the lubricating base oil, and wherein the proportion of cyclic saturated components among the saturated components is 0.1 to 50 wt %.

2. A shock absorber fluid according to claim 1 further comprising a viscosity index improver.

3. A shock absorber fluid according to claim 2, wherein the viscosity index improver content is not greater than 2.5% by mass as the polymer amount based on the total amount of the shock absorber fluid.

4. A shock absorber fluid according to claim 2, wherein the viscosity index improver is a polymethacrylate-based viscosity index improver.

* * * * *